US005113577A

United States Patent [19]

Wildgen

[11] Patent Number: 5,113,577

[45] Date of Patent: May 19, 1992

[54] METHOD FOR PRODUCING A RESISTOR ELEMENT

[75] Inventor: Andreas Wildgen, Nittendorf/Haugenried, Fed. Rep. of Germany

[73] Assignee: Siemens Aktiengesellschaft, Munich, Fed. Rep. of Germany

[21] Appl. No.: 676,570

[22] Filed: Mar. 28, 1991

[30] Foreign Application Priority Data

Mar. 30, 1990 [EP] European Pat. Off. ..... 90106138.2

[51] Int. Cl.[5] ..... H01C 17/06

[52] U.S. Cl. ..... 29/620; 338/292; 338/293

[58] Field of Search ..... 29/620; 338/195, 292, 338/293; 219/121.68, 121.69

[56] References Cited

U.S. PATENT DOCUMENTS 4,429,298 1/1984 Oberholzer ..... 29/620
4,626,822 12/1986 Melkeraaen ..... 338/195

FOREIGN PATENT DOCUMENTS 3117957 11/1982 Fed. Rep. of Germany ..... 219/121.68
3127081 1/1983 Fed. Rep. of Germany .
3042720 10/1984 Fed. Rep. of Germany .
138489 11/1979 German Democratic Rep. ... 29/620

*Primary Examiner*—P. W. Echols
*Attorney, Agent, or Firm*—Herbert L. Lerner; Laurence A. Greenberg

[57] ABSTRACT

A resistor element includes a substrate, end pieces, a resistor layer applied to the substrate, a resistor array formed by cutting the resistor layer, and the resistor array having a resistance with a set-point value between the end pieces. A method for producing the resistor element includes cutting apart the resistor layer according to a predetermined cut structure. The resistor array is formed between the end pieces on the substrate in the form of at least one resistor track having a substantially constant width and constant cross section. The cut structure is shaped with two comb-like individual structures each having a main cut and a plurality of secondary cuts originating at the main cut and extending to a respective side. The secondary cuts of the individual structures are intermeshed with one another and the individual structures are spaced apart form one another. The resistance of the resistor array is set below the set-point value. The resistor element is calibrated to the set-point value by removing portions of the resistor layer. The resistor element is calibrated by making a trimming cut in the resistor layer originating at a free end of the secondary cut and extending parallel to the secondary cut as far as the main cut.

3 Claims, 1 Drawing Sheet

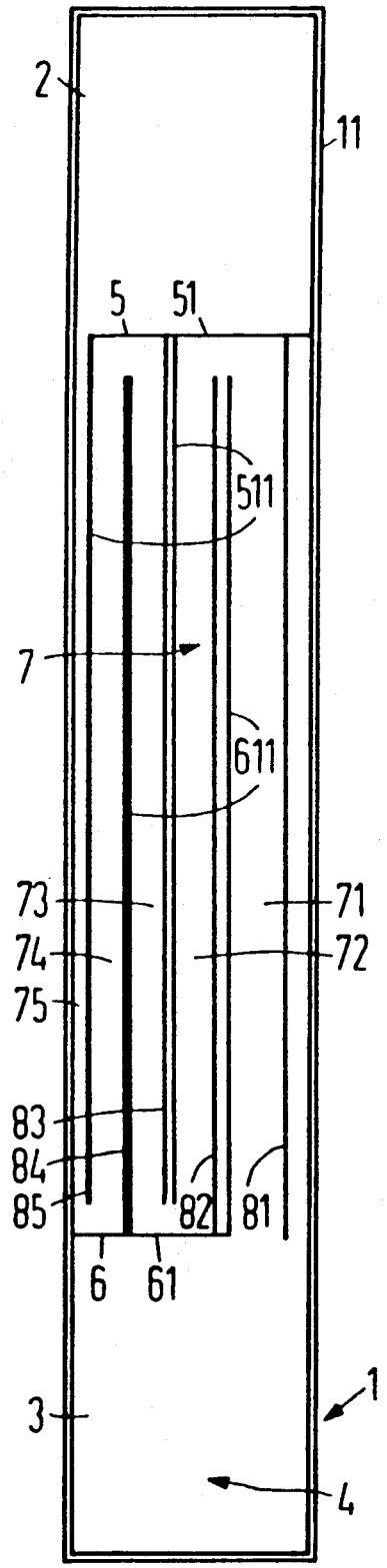
2
11
5
51
511
7
611
73
71
74
72
75
83
84
85
82
81
6
61
3
1
4

METHOD FOR PRODUCING A RESISTOR ELEMENT

The invention relates to a method for producing a resistor element having a substrate, a resistor layer applied to the substrate, a resistor array formed by cutting the resistor layer, and the resistance thereof between end pieces having a set-point value, wherein the resistor layer is cut apart in accordance with a predetermined cutting structure; the resistor array between the end pieces is formed on the substrate in the form of at least one resistor track having a substantially constant width and constant cross section; the cut structure includes two comb-like cut configuration each with a main cut and a plurality of secondary cuts originating at the main cut and extending to one side; and the cut configuration being disposed in such a way that the secondary cuts fit inbetween one another and the cut configuration do not touch one another.

Such a method is known from German Published, Non-Prosecuted Application DE 31 27 081 A1. That patent describes a step of cutting apart the resistor layer with laser cuts in accordance with a predetermined cut structure. The resistances of the resistor elements thus produced exhibit a certain scattering.

A resistor array is known from German Pat. No. DE 30 42 720 C2 in which the resistor is below a set-point value prior to the calibration, and in which the calibration of the resistor element to the set-point value is effected by the removal of portions of the resistor layer. However, a disadvantage of that configuration is that after the calibration, the flow of current through the resistor elements is limited to a portion of it at the periphery, and the current flow heats up that portion, which can cause measurement errors.

It is accordingly an object of the invention to provide a method for producing a resistor element, which overcomes the hereinafore-mentioned disadvantages of the heretofore-known methods of this general type and in which the resistance is within a narrow tolerance range, and the flow of current is distributed over the resistor element.

With the foregoing and other objects in view there is provided, in accordance with the invention, in a method for producing a resistor element having a substrate, end pieces, a resistor layer applied to the substrate, a resistor array formed by cutting the resistor layer, and the resistor array having a resistance with a set-point value between the end pieces, the improvement which comprises cutting apart the resistor layer according to a predetermined cut structure; forming the resistor array between the end pieces on the substrate in the form of at least one resistor track having a substantially constant width and constant cross section; shaping the cut structure with two comb-like individual structures each having a main cut and a plurality of secondary cuts originating at the main cut and extending to a respective side; intermeshing, interlocking or fitting the secondary cuts of the individual structures with or between one another and ensuring that the cut configuration do not touch one another; setting the resistance of the resistor array below the set-point value; calibrating the resistor element to the set-point value by removing portions of the resistor layer; and calibrating the resistor element by making a trimming cut in the resistor layer originating at a free end of the secondary cut and extending parallel to the secondary cut as far as the main cut.

In accordance with another mode of the invention, there is provided a method which comprises coating the resistor layer with a protective layer.

In accordance with a concomitant mode of the invention, there is provided a method which comprises leaving a portion of the resistor layer exposed when the protective layer is applied.

Although the invention is illustrated and described herein as embodied in a method for producing a resistor element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing.

The drawing is a diagrammatic, elevational view of a resistor element calibrated according to the invention.

Referring now in detail to the single figure of the drawing, there is seen a a resistor element including a rectangular substrate 1, on which a rectangular resistor layer 4 of constant cross section and constant width is located, between two end regions 2, 3.

Interruptions, in the form of two cut structures 5, 6, are located in the resistor layer 4.

The various cut structures each include one main cut 51, 61 and a plurality of secondary cuts 511, 611 extending to one side from the main cuts 51, 61. It is seen beginning at an edge 11 of the substrate, that the main cuts 51, 61 extend at a right angle over approximately two-thirds of the resistor layer 4. The secondary cuts 511, 611 originating at the main cuts 51, 61 extend parallel to the substrate edge 11. The cut structures 5 and 6 are disposed relative to one another in such a way that the secondary cuts 511, 611 fit inbetween one another but do not touch one another. As a result of this configuration, a meandering resistor track 7 is produced between the end regions 2, 3. The resistor track 7 is composed of individual partial tracks 71, 72, 73, 74 and 75.

The resistance between the end regions 2, 3, prior to the calibration, is below a set-point value for the calibrated resistor element. In order to calibrate the resistor element to the set-point value, a certain region is cut off of each of the partial tracks 71 to 75 by means of trimming cuts 81 to 85. Beginning at the free end of the secondary cuts 511 and 611, it is seen that the trimming cuts 81 to 85 extend parallel to the secondary cuts. The trimming cuts 81 to 85 end in the respective main cuts 61 and 51 associated with the respective secondary cuts 511 and 611. As a result, the region between one of the secondary cuts 511, 611 and the associated trimming cut is electrically isolated from the remainder of the resistor track. In this way, the calibration is effected with a single trimming cut per partial track 71 to 75.

In the example shown herein, the width of the individual partial tracks 71 to 75 decreases steadily. The trimming cuts 81 to 85 are laid out in such a way that the width of the remaining regions of the partial tracks 71 to 75, through which current flows, decreases equally steadily.

I claim:

1. In a method for producing a resistor element having a substrate, end regions, a resistor layer applied to the substrate, a resistor array formed by cutting the resistor layer, and the resistor array having a resistance with a set-point value between the end regions, the improvement which comprises:

cutting apart the resistor layer according to a predetermined cut structure;

forming the resistor array between the end regions on the substrate in the form of at least one resistor track having a substantially constant width and constant cross section;

forming two comb-like cut configurations each having a main cut and a plurality of secondary cuts originating at the respective main cut and extending in a direction towards the other main cut;

disposing the secondary cuts of the comb-like cut configurations intermeshed with one another and spaced apart from one another;

setting the resistance of the resistor array below the set-point value;

calibrating the resistor element to the set-point value by making a trimming cut in the resistor layer originating in the vicinity of a free end of the secondary cut and extending parallel to the secondary cut as far as the main cut.

2. The method according to claim 1, which comprises coating the resistor layer with a protective layer.

3. The method of claim 2, which comprises leaving a portion of the resistor layer exposed when the protective layer is applied.

* * * * *